United States Patent [19]

Bööse

[11] 3,986,453

[45] Oct. 19, 1976

[54] DEVICE FOR STRIPPING EXCESS INK FROM A ROTATING PRINTING ROLL IN ROTOGRAVURE PRESSES

[75] Inventor: Åke Arthur Bööse, Lidingo, Sweden

[73] Assignee: Ahlen & Akerlunds Forlags AB, Stockholm, Sweden

[22] Filed: Apr. 1, 1975

[21] Appl. No.: 563,967

[30] Foreign Application Priority Data

Apr. 8, 1974 United Kingdom ..... 15554/74

[52] U.S. Cl. ..... 101/169; 15/256.51

[51] Int. Cl.[2] ..... B41F 9/10

[58] Field of Search ..... 101/169, 170, 154, 155, 101/157, 161, 425; 15/236 R, 236 A, 256.50, 256.51, 256.52

[56] References Cited

UNITED STATES PATENTS

| | | | |
|---|---|---|---|
| 1,561,513 | 11/1925 | Frossard | 15/256.51 |
| 1,812,920 | 7/1931 | Ballard | 101/157 |
| 2,007,418 | 7/1935 | Akre | 15/256.51 |
| 2,086,075 | 7/1937 | Gilbertson | 101/169 |
| 2,151,969 | 3/1939 | Henderson | 101/157 |
| 2,361,554 | 10/1944 | Lundbye | 101/169 X |
| 2,914,788 | 12/1959 | Smith et al. | 15/256.51 |
| 3,255,038 | 6/1966 | Coghill | 15/256.51 |
| 3,521,561 | 7/1970 | Pali et al. | 101/170 X |
| 3,623,965 | 11/1971 | Owren | 101/157 |

FOREIGN PATENTS OR APPLICATIONS

| | | | |
|---|---|---|---|
| 1,164,098 | 10/1958 | France | 101/169 |
| 51,906 | 12/1932 | Norway | 15/256.51 |

*Primary Examiner*—E. H. Eickholt
*Attorney, Agent, or Firm*—Ostrolenk, Faber, Gerb & Soffen

[57] ABSTRACT

The present invention relates to apparatus for stripping printing ink from a rotating printing roll in rotogravure presses with the help of a doctor knife which is removably attached to a holder adapted to hold the stripping edge of the knife in engagement with the printing roll with a predetermined engagement pressure.

2 Claims, 4 Drawing Figures

DEVICE FOR STRIPPING EXCESS INK FROM A ROTATING PRINTING ROLL IN ROTOGRAVURE PRESSES

BACKGROUND OF THE INVENTION

The present invention relates to devices in rotogravure presses where excess ink is to be stripped from a rotating printing roll, in the surface of which there are arranged depressions for filling with printing ink, the excess ink being removed with a doctor knife. The doctor knife is attached to a holder carried by an adjustable apparatus which determines the force with which the scraping edge of the knife lies against the printing roll. Such knives are exposed to wear and must be changed after a period of use. On certain occasions a change must sometimes be made for cleaning the knife.

The doctor knife usually consists of a blade which, in a known embodiment, is formed along its width with a thinner forward portion and a thicker rear portion, said portions dividing up the width of the knife into two parts. The relatively shallow thickness of the forward portion has been obtained by a comparatively expensive grinding operation.

The free edge of the thinner portion is intended for use as a stripping edge, while the thicker portion is intended for clamping in a standard type of knifeholder for the printing machinery in question. The advantage with the thin portion is that wear on it can take place without the wear causing any unacceptable alteration of the scraping edge engagement surface against the printing roll.

The known doctor knife furthermore has the inconvenience that its wear resistance is not great so that the knife must sometimes be changed while printing a normal edition, the downtime caused by changing knives thus also involving an increase in cost. When changing knives, the knife is removed together with a relatively heavy removable portion of the standard holder and is carried to a place for changing the knife or to a hot steam bath in which the knife is to be cleaned. This work is often arduous, since the weight of the removable holder portion and the knife attached thereto is considerable, and the walking distance in the printing hall to the place of deposition or to the steam bath is in many cases so long that the holder portion with knife suitably should be transported on a trolley.

OBJECT AND BRIEF DESCRIPTION OF THE INVENTION

The object of the present invention is therefore to obtain a reduction of the costs encountered in the use of a doctor knife on printing rolls, by using simple means, the purpose of the invention being to provide a knife blade holder assembly enabling exchange in a simpler way than the known knives, and enabling cleaning without needing treatment in a steam bath, which requires a subsequent relatively long cooling period before the knife can be used again.

This is achieved by a method and device according to the invention with the distinguishing features which are apparent from the following patent claims.

In the method according to the invention a very thin steel strip with a substantially constant thickness in the range from 0.05 – 0.15 mm, and usually of the order of 0.1 mm is used as a knife blade. The edges of the steel strip are accurately made parallel to each other. This steel strip is clamped between two springloaded plates, incorporated in an extra holder according to the invention and which is attachable to the standard doctor knife holder for the machine. A suitable type of steel strip is supplied by Uddeholms AB.

Such a steel strip is so thin that it can be bent on edge to a certain extent, which has a certain importance in assembly and dismantling of the knife blade in the extra holder according to the invention, as will be appreciated from the following description.

According to the invention the knife blade can be clipped off from steel strip delivered by the meter, the cost per knife blade in certain cases being more than 15 times lower than for the known doctor knives.

In using a thin steel strip as a doctor knife blade, the thin and easily flexible steel strip will accurately adjust itself to possible unevennesses of the roll. This objective is also enhanced by the doctor knife being resiliently clamped in the extra holder according to the invention, whereat clamping takes place at a plurality of individually sprung clamping places.

In the extra holder according to the invention, the thin doctor knife blade is clamped between two clamping plates, which are mutually located by a row of through-going bolts, and compressed by means of a spring device at each bolt. By acting on the spring devices one after the other, or all at the same time, clamping pressure can be eased for introducing the blade between the clamping plates. In this way the bolts serve as stops for the doctor knife blade, so that it can easily be assembled in an exact position with its free forward edge accurately parallel to the row of bolts and with the long sides of the clamping plates. One clamping plate is wider than the other, and can be rigidly attached in an adjustable position to the standard holder for doctor knives known per se for the printing machine.

Even if it is possible without any great difficulty to free and change the knife from the extra holder according to the invention, when this is fixed in the standard holder of the machine, it is more convenient and quick to free the extra holder. The holder can then easily be placed in a special clamping device with two jaws, between which the extra holder with the knife blade is so placed that the jaws, on being tightened, actuate all the spring devices simultaneously, so that the pressure of the clamping plates is reduced and the knife blade can be lifted out of the holder and replaced with a new one. Dismantling can also be done by gripping one end of the knife blade and bending the blade on edge simultaneously as the blade is successively withdrawn from its clamped position. When inserting the new doctor knife blade, it can be suitable to have a certain clamping pressure between the clamping plates to enable an alternative assembly, carried out in the following way. The easily flexible doctor knife blade can be difficult to handle when it is to be inserted between the clamping plates in their open position. If the clamping plates are instead allowed to engage each other with a certain clamping pressure, which can be full clamping pressure, it is easy to assemble the blade by fastening one end thereof between the plates at one end of them, whereafter the blade is bent on edge and successively pressed inbetween the clamping plates, e.g. by drawing a rag along the blade and pressing it down between the plates. In this case the blade is under full control and can be pressed down to accurate engagement with the bolts to bring the blade into an exact, and therefore, desired position in the extra holder.

When assembling the doctor knife blade in the extra holder according to the invention, it can be suitable in certain cases to use aluminium foil as protection against ink splashes. This foil is bent double over the inner edge of the blade which is pressed into the extra holder between its clamping plates. Both halves of the foil on either side of the blade have substantially greater width than the blade. After clamping the blade in the extra holder the folio halves are folded back again from the blade and smoothed protectingly over adjacent portions of the extra holder to guard these members against ink splashes during operation. The extra holder is hereby kept free from ink splashes and does not need to be washed, i.e. the downtime is avoided which is usually required for the holder and knife blade to have cooled after washing in a hot steam bath to a predetermined temperature enabling re-use.

BRIEF DESCRIPTION OF THE FIGURES

A suitable embodiment of an extra holder for the doctor knife blade according to the invention is shown as an example on the attached drawings, in which.

DETAILED DESCRIPTION OF THE INVENTION

Figure 1:
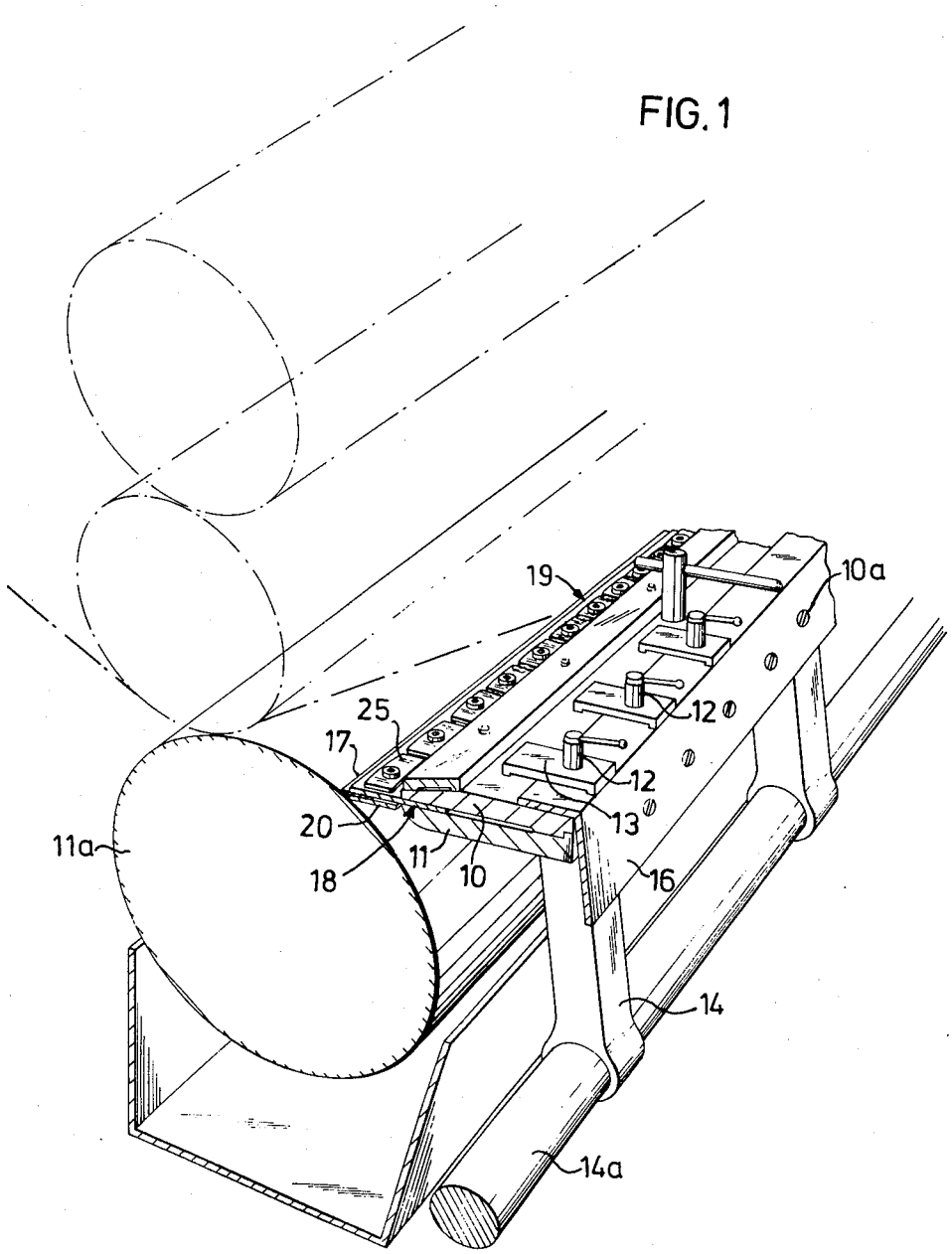
FIG. 1 is a schematic perspective view of a rotatable printing roll in a rotogravure machine with a standard holder for doctor knives of known shape, and an extra holder for the doctor knife according to the invention clamped to the standard holder.
Figure 2:
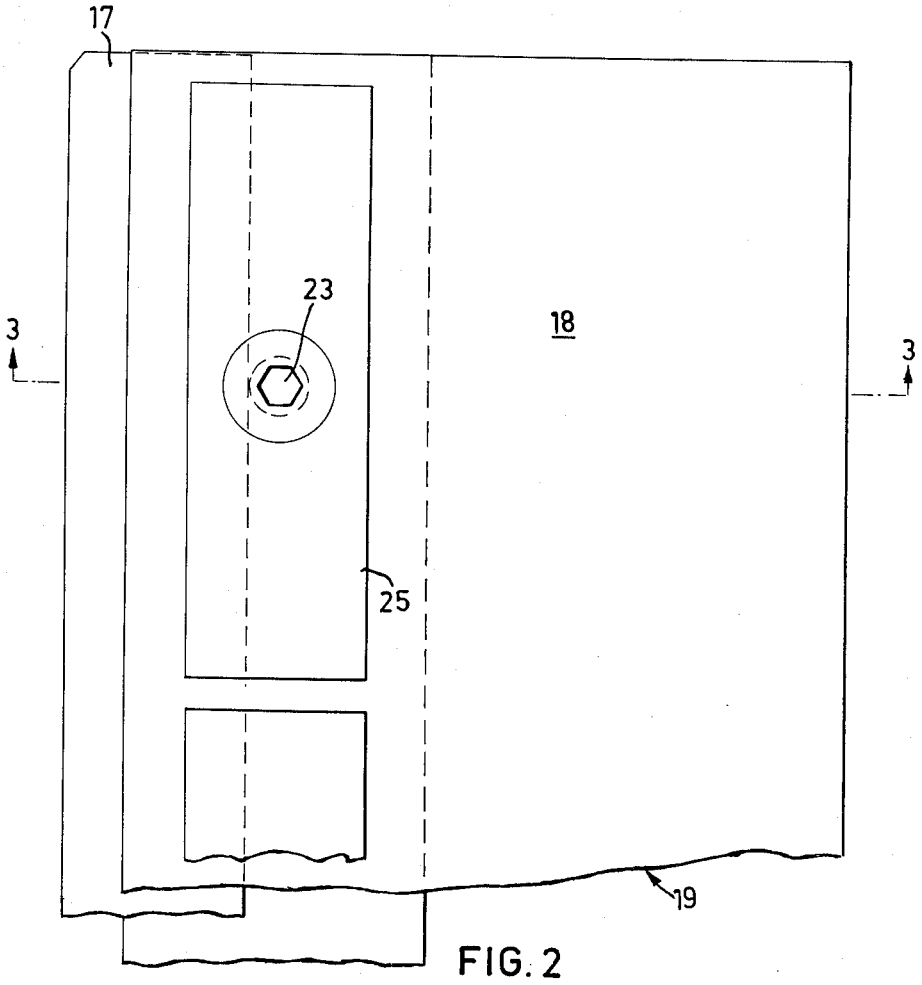
FIG. 2 is a fragmentary plan view of one end of the extra holder according to the invention, and a doctor knife blade according to the invention resiliently clamped to it.

As is schematically shown in FIG. 1, the standard holder for known doctor knives for a printing press consists of a top plate 10 and a bottom plate 11, whereof the top plate 10 is clamped against the bottom plate by means of clamping bolts 12 and clamping plates 13 for clamping a knife between the plates. This known standard holder is furthermore provided with transverse set screws 10*a*, the inner ends (not shown) of which form adjustable stops for the inner edge of the knife, so that the knife can be adjusted for correct engagement of the stripping edge of the known knife (not shown) against the printing roll 11*a*.

In a known way, the standard holder 10, 11 is pivotable relative to a part 16 which is carried by a number of arms 14 attached to a shaft 14*a* rotatably journalled in the press frame. Between the part 16 respective to the arms 14 and the standard holder 10, 11 there is a pneumatic spring means (not shown) which acts on the standard holder in a pivoting direction towards the cylinder 11*a*. For changing knives, the supporting means 16, 14, of the standard holder is swingable from the shown working position to a disengaged position.

According to the invention, the doctor knife consists of a thin and steel strip 17 of substantially constant thickness, which strip is resiliently clamped in an extra holder 19, consisting of a wide plate 18 which is clamped between the clamping plates 10, 11 in the same way as the known knife, and a narrower plate 20, which is disposed with its front edge flush with the front edge of the wide plate. The plates 18, 19 are held in this position by a plurality of throughgoing bolts 21 (FIGS. 3, 4) arranged in a straight row, and having an end stop at one end in the shape of a bolt head 22 with a recessed spanner grip 23 and an end stop at the other end in the shape of a nut 24.

Under each bolt head there is an arched flat spring 25 with a hole through which the bolt 21 is inserted, both ends of the arms of the flat spring 25 resiliently engaging the plate 18, and the middle portion of the flat spring engaging the bolt head so that desired clamping force is obtained between the front edge portions of the plate 18, 20.

Figure 3:
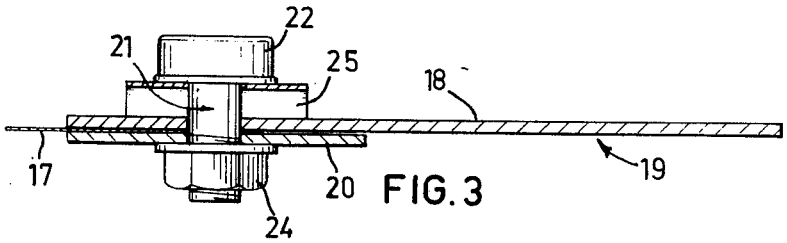
FIG. 3 is a cross-section through the extra holder with the knife blade resiliently clamped to it.
Figure 4:
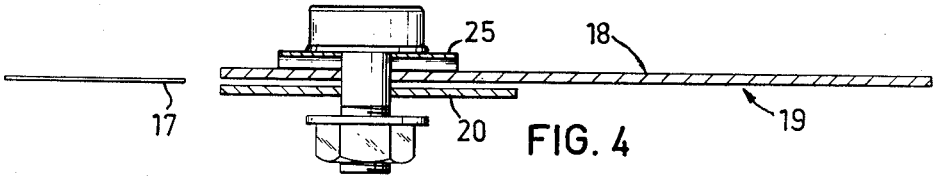
FIG. 4 shows the same cross-section, with the difference that the thin knife blade consisting of an evenly thick steel strip is shown separately and in a position in front of the extra holder, which is shown in an open position.

The free length of the bolt between the head 22 and nut 24 is thereby substantially greater than the combined thicknesses of plates 18, 20, so that on depressing the bolt 21 through the holes in the plate 18, 20 from the clamping position shown in FIG. 3 to the open position shown in FIG. 4 against the action of flat springs 25, the plates 18, 20 will relinquish the resilient contact with each other and with the knife blade 17 between the plates, respectively.

The holes in the plates 18, 20 accurately fit the bolts 21 and lie in a straight row parallel to the edges of the plate 18, primarily to the rear edge of the plate. This enables a convenient insertion of the knife blade 17 to an accurately determined position by the blade 17 being inserted to engagement with the bolts 21, which thus also serve as stops for the blade 17.

As distinguished from the known doctor knife, the knife blade 17 is not directly fixed in the standard holder 10, 11 but by the intermediary of the extra holder 19 which is adapted for resilient clamping of the thin knife blade 17 according to the invention.

The plates 18, 20 suitably consist of spring steel. The weight of the extra holder 19 will be relatively small in relation to the previously used removable holder parts with attached knife, this enabling more convenient handling of the extra holder with the knife blade in relation to what has previously been possible.

The knife blade 17 consists of a thin steel strip with constant thickness and width, the thickness of the strip being in the area 0.05 – 0.15 mm, suitably about 0.10 mm depending, amongst other things, on the size and speed of the printing roll used. The thickness of the knife blade is thus so small that the strip or blade 17 can be bent on edge, enabling the strip to be respectively drawn successively out from or pressed successively between the plates 18, 20 along the length of the strip, from one end to the other, even when the plates 18, 20 are spring loaded.

Since the knife blade consists of a very thin steel strip, it can easily adjust itself to unevennesses which may be present on the surface of the printing roll, and this adjusting capacity is further increased by the strip being clamped with spring bias at a plurality of individually resilient clamping points, i.e. by means of the flat springs 25. The extra holder 19 and the knife blade 17 have approximately the same length as the printing roll 11*a*.

What I claim is:

1. Apparatus for stripping printing ink from a rotating printing roll in rotogravure presses with the help of a doctor knife which is removably attached to a holder adapted to hold the stripping edge of the knife in engagement with the printing roll with a predetermined engagement pressure, said apparatus comprising the aforesaid doctor knife being a thin steel strip having parallel side edges and a substantially constant thickness over its entire width and a length which is slightly greater than the length of the printing roll, the thickness of said steel strip lying in the range from 0.05 to 0.15 mm;

an adjustable standard holder for holding a standard doctor blade;

an extra holder assembly adapted to be clamped by said standard holder;

the extra holder assembly comprising first and second clamping plates, the width of said second clamping plate being greater than the width of said first clamping plate;

said clamping plates being mounted against one another;

said clamping plates each having a set of openings arranged along an imaginary substantially straight line;

said openings in said plates being coaligned so as to bring a first edge of said narrow plate into alignment with a first edge of said wider plate;

fastening assemblies being positioned through each set of coaligned openings;

the second edge of said wider plate extending away from the second edge of said narrower plate and adapted to be mounted within the standard clamping means;

said fastening means comprising a head having a body portion extending therefrom and a cooperating threaded fastener mounted upon the free end of said body so that the distance between said head and said threaded fastener is greater than the combined thicknesses of said narrow and wide clamping plates;

an arched flat spring having an intermediate opening;

said spring being positioned between the head of said fastening means and one of said clamping plates so that the body of said fastening means passes through the intermediate opening in said spring;

said spring resiliently engaging the adjacent clamping plate for applying the desired clamping force between said plates;

the aforesaid thin steel strip serving as the doctor knife being positioned between said narrow and wide clamping plates so that one of its edges abuts the bodies of said fastening means while the opposite free edge of said steel strip is directed beyond the coaligned edges of said narrow and wide plates to serve as the edge for stripping ink from the printing roll;

said resilient spring being adapted to enable the doctor knife blade to be removed by enabling movement of the fastening means against the biasing forces of the springs to ease the clamping pressure between the clamping plates.

2. Apparatus for stripping printing ink from a rotating printing roll in rotogravure presses with the help of a doctor knife which is removably attached to a holder adapted to hold the stripping edge of the knife in engagement with the printing roll with a predetermined engagement pressure, said apparatus comprising the aforesaid doctor knife being a thin steel strip having parallel side edges and a substantially constant thickness over its entire width and a length which is slightly greater than the length of the printing roll, the thickness of said steel strip lying in the range from 0.05 to 0.15 mm;

an adjustable standard holder for holding a standard doctor blade;

an extra holder assembly adapted to be clamped by said standard holder;

the extra holder assembly comprising first and second clamping plates, the width of said second clamping plate being greater than the width of said first clamping plate;

said clamping plates being mounted against one another;

said clamping plates each having a set of openings arranged along an imaginary substantially straight line;

said openings in said plates being coaligned so as to bring a first edge of said narrow plate into alignment with a first edge of said wider plate;

fastening assemblies being positioned through each set of coaligned openings;

the second edge of said wider plate extending away from the second edge of said narrower plate and adapted to be mounted within the standard clamping means;

said fastening means comprising a head having a body portion extending therefrom and a cooperating threaded fastener mounted upon the free end of said body so that the distance between said head and said threaded fastener is greater than the combined thicknesses of said narrow and wide clamping plates;

an arched flat spring having an intermediate opening;

said spring being positioned between the head of said fastening means and one of said clamping plates so that the body of said fastening means passes through the intermediate opening in said spring;

said spring resiliently engaging the adjacent clamping plate for applying the desired clamping force between said plates;

the aforesaid thin steel strip serving as the doctor knife being positioned between said narrow and wide clamping plates so that one of its edges abuts the bodies of said fastening means while the opposite free edge of said steel strip is directed beyond the coaligned edges of said narrow and wide plates to serve as the edge for stripping ink from the printing roll;

said spring biasing means adapted to be moved by said fastening means as the thin doctor knife blade is withdrawn successively from the clamping position between the clamping plates as the blade is gripped at one end thereof and bent on edge while being withdrawn.

* * * * *